US010328441B2

(12) United States Patent
Jang

(10) Patent No.: US 10,328,441 B2
(45) Date of Patent: Jun. 25, 2019

(54) NOZZLE UNIT AND COATING APPARATUS INCLUDING THE SAME

(71) Applicant: SEMES CO., LTD., Cheonan-si, Chungcheongnam-do (KR)

(72) Inventor: Juyong Jang, Cheonan-si (KR)

(73) Assignee: Semes Co., Ltd., Chungcheongnam-Do (KR)

( * ) Notice: Subject to any disclaimer, the term of this patent is extended or adjusted under 35 U.S.C. 154(b) by 0 days.

(21) Appl. No.: 15/468,257

(22) Filed: Mar. 24, 2017

(65) Prior Publication Data

US 2017/0312770 A1 Nov. 2, 2017

(30) Foreign Application Priority Data

Apr. 29, 2016 (KR) ..... 10-2016-0052936
May 27, 2016 (KR) ..... 10-2016-0065580

(51) Int. Cl.

| | |
|---|---|
| ***B05B 7/22*** | (2006.01) |
| ***B05B 7/16*** | (2006.01) |
| ***C23C 24/04*** | (2006.01) |
| ***B05B 5/03*** | (2006.01) |
| ***B05B 7/14*** | (2006.01) |

(52) U.S. Cl.

CPC ..... *B05B 7/226* (2013.01); *B05B 5/032* (2013.01); *B05B 7/1486* (2013.01); *B05B 7/1606* (2013.01); *C23C 24/04* (2013.01)

(58) Field of Classification Search

None

See application file for complete search history.

(56) References Cited

U.S. PATENT DOCUMENTS 6,073,578 A * 6/2000 Shim ..... C23C 14/0026 118/723 I
2007/0056578 A1* 3/2007 Aviles ..... B01D 45/06 126/299 D (Continued)

FOREIGN PATENT DOCUMENTS

CN 101378007 A 3/2009
CN 101653047 A 2/2010

(Continued)

OTHER PUBLICATIONS

Kwing-So Choi et al. "Plasma Virtual Actuators for Flow Control". Journal of Flow Control, Measurement & Visualization. Scientific Research Publishing. 2015. p. 22-34.

*Primary Examiner* — Jethro M. Pence
(74) *Attorney, Agent, or Firm* — Harness, Dickey & Pierce, P.L.C.

(57) ABSTRACT

An embodiment includes a coating apparatus comprising: a support unit for supporting a coating object; and a spray assembly for spraying a fluid which includes a coating material to be coated by the coating object supported on the support unit. The spray assembly comprises: a nozzle unit where the fluid is sprayed; and a fluid supply unit for supplying the fluid to the nozzle unit. The nozzle unit comprises: a body including a passageway for the fluid therein and a dielectric unit provided with a dielectric material; and a plasma source for generating plasma from the fluid which flows to an area adjacent to inner lateral surface of the dielectric unit. The plasma source comprises: a power electrode applying a power; and a ground electrode to be grounded.

13 Claims, 4 Drawing Sheets

(56) References Cited

U.S. PATENT DOCUMENTS

| | | | | |
|---|---|---|---|---|
| 2012/0138584 | A1 | 6/2012 | Ashtekar et al. | |
| 2012/0143121 | A1* | 6/2012 | Kim | A61M 35/00 604/24 |

FOREIGN PATENT DOCUMENTS

| | | | |
|---|---|---|---|
| CN | 101822885 | A | 9/2010 |
| CN | 101863536 | A | 10/2010 |
| CN | 204582923 | U | 8/2015 |
| JP | 3975272 | B2 | 9/2007 |
| JP | 5688651 | B2 | 3/2015 |
| KR | 2000-0025310 | A | 5/2000 |
| KR | 100575139 | B1 | 4/2006 |
| KR | 100813698 | B1 | 3/2008 |
| KR | 101001477 | B1 | 12/2010 |
| KR | 2012-0063321 | A | 6/2012 |
| KR | 101482412 | B1 | 1/2015 |

* cited by examiner

NOZZLE UNIT AND COATING APPARATUS INCLUDING THE SAME

CROSS-REFERENCE TO RELATED APPLICATIONS

A claim for priority under 35 U.S.C. § 119 is made to Korean Patent Application No. 10-2016-0052936 filed on Apr. 29, 2016 and Application No. 10-2016-0065580 filed on May 27, 2016 in the Korean Intellectual Property Office, the entire contents of which are hereby incorporated by reference.

BACKGROUND

This disclosure relates to a nozzle unit where a fluid including a coating material is sprayed and a coating apparatus including the same.

Cold spray coating is one of a spray coating method which applies coating by spraying a powder which needs to be coated. Cold spray coating is a process of applying coatings to a material by spraying with high velocity using collision energy with basic material in a room temperature where the material reacts or its coordination does not change, or in a low temperature.

FIG. 1 is a lateral cross-sectional view briefly illustrating inside of a nozzle 1 of a conventional coating apparatus. Referring to FIG. 1, a cold spray coating apparatus supplies a powder and a gas to the nozzle 1. The gas provides a pressure to spray powders. A flow velocity of the gas including powders is the highest in a center 2 of the nozzle 1 by its viscosity. The velocity of the gas decreases as moving to inner lateral wall 3 of the nozzle 1, and gets close to 0 when the gas reaches an area adjacent to the inner lateral wall 3 of the nozzle 1. Due to decrease in velocity, it requires a gas with higher pressure thereby lowering energy efficiency. Also, powder particles moving along the inner lateral wall 3 adjacently have lower momentum. Upon impact with a basic material, the particles experience elastic collision which occur no coatings or some coatings thereby causing a Void and losing the coating material. Therefore, cold spray coating requires long time to form a coating layer due to loss of the coating material and is not simple to form coating layer over certain thickness.

SUMMARY

An embodiment includes an apparatus to prevent decrease in a flow velocity in an area adjacent to an inner lateral wall of a nozzle.

An embodiment includes an apparatus to increase energy efficiency.

An embodiment includes an apparatus to minimize poor coating.

An embodiment includes an apparatus to minimize coating layer formation time.

An embodiment includes an apparatus to easily form thicker coating layer.

The objects of the inventive concept are not limited to the above mentioned disclosure. Other objects thereof will be understandable by those skilled in the art from the following descriptions and drawings.

Example embodiments of the inventive concept may provide a coating apparatus comprising: a support unit for supporting a coating object; and a spray assembly for spraying a fluid which includes a coating material to be coated by the coating object supported on the support unit.

The spray assembly comprises: a nozzle unit where the fluid is sprayed; and a fluid supply unit for supplying the fluid to the nozzle unit. The nozzle unit comprises: a body including a passageway for the fluid therein and a dielectric unit provided with a dielectric material; and a plasma source for generating plasma from the fluid which flows to an area adjacent to inner lateral surface of the dielectric unit. The plasma source comprises: a power electrode applying a power; and a ground electrode to be grounded.

In example embodiments, the power electrode and the ground electrode are placed apart from each other in the dielectric unit.

In example embodiments, the power electrode may surround a center shaft of the body and may be a helical shape having a plurality of turns arranged along a lengthwise of the body. The ground electrode may surround a center shaft of the body and may be a helical shape having a plurality of turns arranged along a lengthwise of the body.

In example embodiments, when viewed from a lateral side, each of the turns of the power electrode and the turns of the ground electrode are departed from each other.

In example embodiments, the turn of the power electrode is provided closer to a turn which is closer to a spray hole where the fluid of the body is sprayed among the turns of the ground electrode.

In example embodiments, each distance between the turns close to each other of the power electrode may be the same, and each distance between the turns close to each other of the ground electrode may be the same.

In example embodiments, the distance between the turns close to each other of the power electrode and a distance between the turns close to each other of the ground electrode may be the same.

In example embodiments, the power electrode may surround a center shaft of the body and may be a plurality of rings arranged along a lengthwise of the body. The ground electrode may surround a center shaft of the body and may be a plurality of rings arranged along a lengthwise of the body.

In example embodiments, each ring of the power electrode and each ring of the ground electrode are arranged alternately, when viewed from a lateral side.

In example embodiments, the ring of the power electrode is provided closer to a ring which is closer to a spray hole where the fluid of the body is sprayed among the rings of the ground electrode.

In example embodiments, each distance between the rings close to each other of the power electrode may be the same, and each distance between the rings close to each other of the ground electrode may be the same.

In example embodiments, the distance between the rings close to each other of the power electrode and the distance between the rings close to each other of the ground electrode may be the same.

In example embodiments, the power electrode may be placed such that its outer lateral surface is further apart from the inner lateral surface of the dielectric unit with respect to the center shaft of the body.

In example embodiments, the power electrode may be provided to the inner lateral surface of the dielectric unit, and the ground electrode may be provided to an outer lateral surface of the dielectric unit.

In example embodiments, the dielectric unit may form a power electrode groove inserted with the power electrode in the inner lateral surface and may form a ground electrode groove inserted with the ground electrode in the outer lateral surface.

In example embodiments, the power electrode and the ground electrode may be provided in the outer lateral surface of the dielectric unit.

In example embodiments, the dielectric unit may include a power electrode groove inserted with the power electrode and a ground electrode groove inserted with the ground electrode in the outer lateral surface.

In example embodiments, the nozzle unit further comprises an insulator surrounding the outer lateral surface of the dielectric unit so that the power electrode and the ground electrode may not expose to outside.

In example embodiments, the fluid supply unit comprises: a coating material supply member for supplying the coating material; and a gas supply member for supplying a pressure gas for applying a power to spray the coating material.

In example embodiments, the coating material may be a powder form.

Example embodiments of the inventive concept may provide a nozzle unit where the fluid is sprayed which includes a coating material to be coated by the coating object. The nozzle unit comprising: a body including a passageway for the fluid therein and a dielectric unit provided with a dielectric material; and a plasma source for generating plasma from the fluid which flows to an area adjacent to inner lateral surface of the dielectric unit. The plasma source comprises: a power electrode applied with a power; and a ground electrode to be grounded.

In example embodiments, the power electrode and the ground electrode are placed apart from each other in the dielectric unit.

In example embodiments, the power electrode may surround a center shaft of the body and may be a helical shape having a plurality of turns arranged along a lengthwise of the body. The ground electrode may surround a center shaft of the body and may be a helical shape having a plurality of turns arranged along a lengthwise of the body.

In example embodiments, when viewed from a lateral side, each of the turns of the power electrode and the turns of the ground electrode are departed from each other.

In example embodiments, the turn of the power electrode is provided closer to a turn which is closer to a spray hole where the fluid of the body is sprayed among the turns of the ground electrode.

In example embodiments, the power electrode may surround a center shaft of the body and may be a plurality of rings arranged along a lengthwise of the body. The ground electrode may surround a center shaft of the body and may be a plurality of rings arranged along a lengthwise of the body.

In example embodiments, each ring of the power electrode and each ring of the ground electrode are arranged alternately, when viewed from a lateral side.

In example embodiments, the ring of the power electrode is provided closer to a ring which is closer to a spray hole where the fluid of the body is sprayed among the rings of the ground electrode.

Embodiments of the inventive concepts may provide an apparatus to prevent decrease in a flow velocity in an area adjacent to an inner lateral wall of a nozzle.

An embodiment may provide an apparatus to increase energy efficiency.

An embodiment may provide an apparatus to minimize poor coating.

An embodiment may provide an apparatus to minimize coating layer formation time.

An embodiment may provide an apparatus to easily form thicker coating layer.

DETAILED DESCRIPTION OF THE EMBODIMENTS

Figure 1:
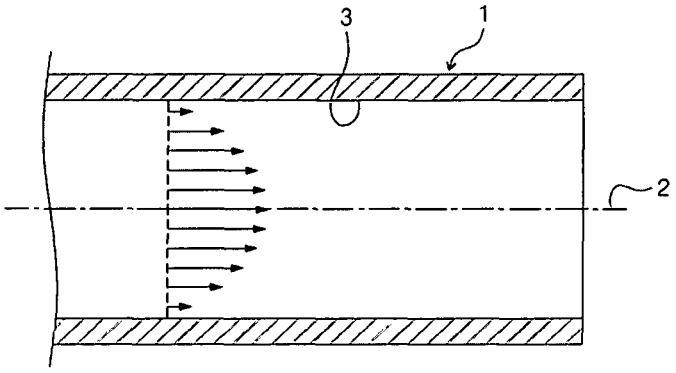
FIG. 1 is a lateral cross-sectional view briefly illustrating inside of a nozzle of a conventional coating apparatus.

Embodiments will be described below in more detail with reference to the accompanying drawings. Embodiments may, however, take different forms and should not be constructed as limited to the particular embodiments set forth herein. Rather, these embodiments are provided so that this disclosure will be thorough and complete, and will fully convey the scope to those skilled in the art. In the drawings, shapes are exaggerated for clarity.

In example embodiments, a cold spray coating apparatus for spraying a coating material which needs to be coated with high velocity in a room temperature where the material reacts or its coordination does not change, or in a low temperature. However, the inventive concept is not limited hereinafter but may be applied to various apparatus including a nozzle where a material is sprayed.

Figure 2:
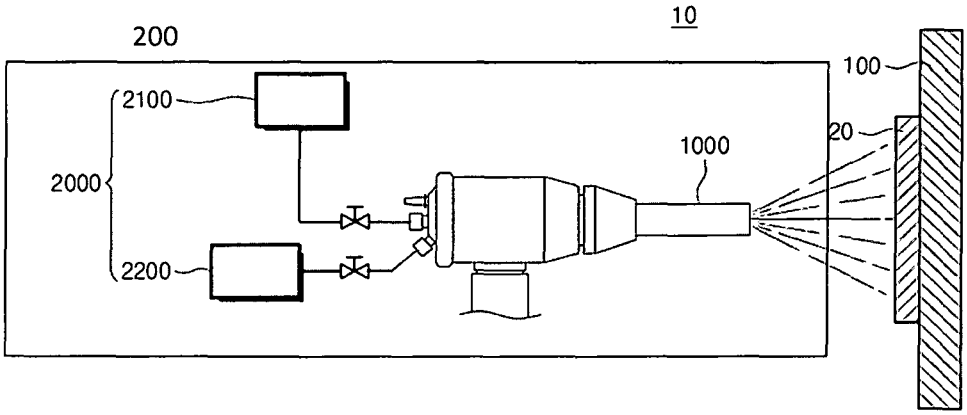
FIG. 2 is a view illustrating a coating apparatus in accordance with an embodiment.

FIG. 2 is a view illustrating a coating apparatus 10 in accordance with an embodiment. Referring to FIG. 2, the coating apparatus 10 includes a support unit 100 and a spray assembly 200.

The support unit 100 supports a coating object 20. The support unit 100 may support the coating object 20 in various ways. For example, the support unit 100 may support the coating object 20 by mechanical clamping or by vacuum lift. Also, the support unit 100 may support the coating object 20 in various angles. In an embodiment, the support unit 100 may support the coating object 20 such that a surface of the coating object 20 which will be coated may be vertical to a plane. However, the support unit 100 may support the coating object 20 such that the surface of the coating object 20 which will be coated may be parallel to the plane. The support unit 100 may selectively support the coating object 20 in various angles.

The spray assembly 200 sprays a fluid to the coating object 20 supported on the support unit 100. In an embodiment, the spray assembly 200 includes a nozzle unit 1000 and a fluid supply unit 2000.

Figure 3:
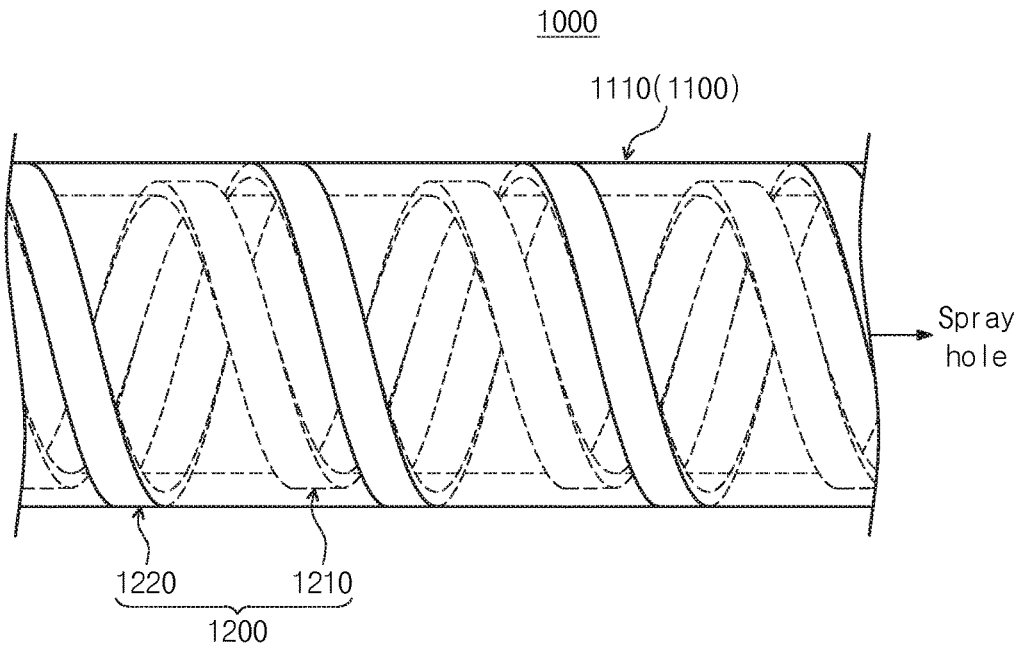
FIG. 3 is a perspective view of a part of a nozzle unit of FIG. 2.
Figure 4:
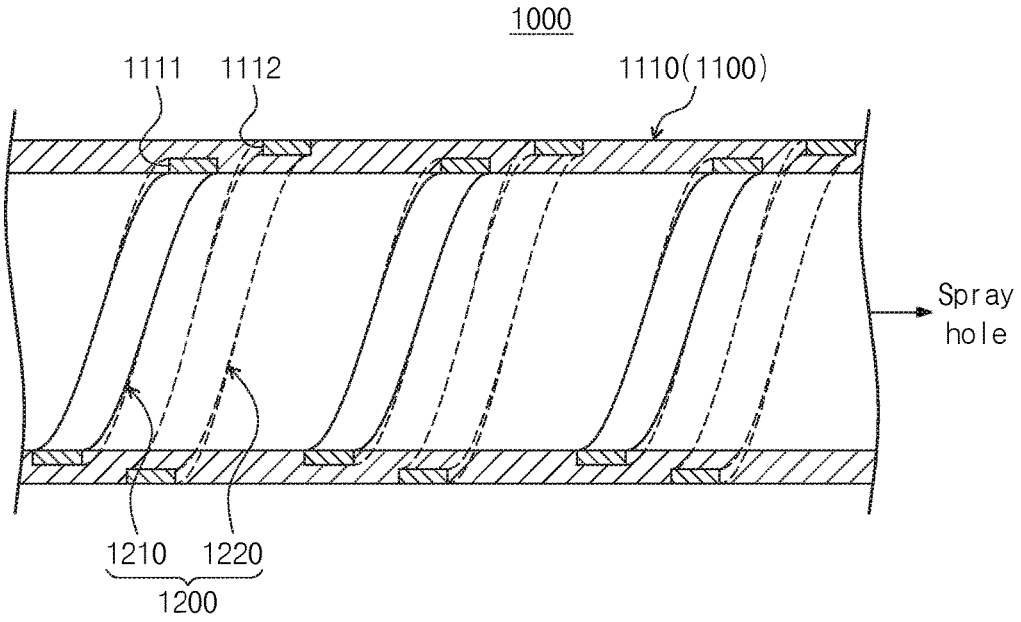
FIG. 4 is a lateral cross-sectional view of a part of a nozzle unit of FIG. 2.

A fluid is sprayed through the nozzle unit 1000. FIG. 3 is a perspective view of a part of the nozzle unit 1000 of FIG. 2. FIG. 4 is a lateral cross-sectional view of a part of the nozzle unit 1000 of FIG. 2. Referring to FIGS. 3 and 4, the nozzle unit 1000 includes a body 1100 and a plasma source 1200.

The body 1100 includes a passageway therein. The body 1100 includes a dielectric unit 1110 provided with a dielectric material. The entire body 1100 may be the dielectric unit 1110. However, some part of the body 1100 may be the dielectric unit 1110. In this case, an area of the body 1100 which corresponds to an area surrounding a power electrode 1210 and a ground electrode 1220 may be the dielectric unit 1110.

Figure 5:
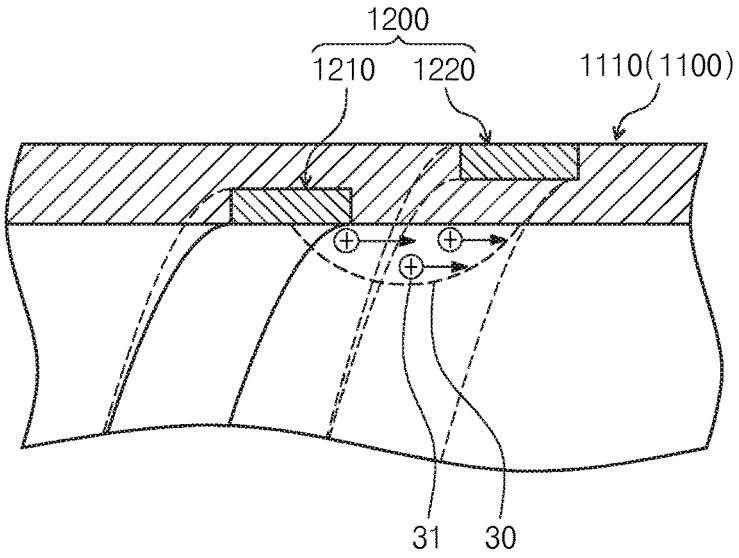
FIG. 5 is an enlarged view of a part of FIG. 4.

FIG. 5 is an enlarged view of a part of FIG. 4. Referring to FIGS. 3 to 5, the plasma source 1200 generates plasma 30 from a fluid which flows to an area adjacent to an inner lateral surface of the dielectric unit 1110. In an embodiment, the plasma source 1200 includes a power electrode 1210 and a ground electrode 1220. The power electrode 1210 and the ground electrode 1220 are placed apart from each other in the dielectric unit 1110. The power electrode 1210 may be placed such that its outer lateral surface is further apart from the inner lateral surface of the dielectric unit 1110 with respect to a center shaft of the body 1100.

In the power electrode 1210, a power is applied to form an electric filed from the power electrode 1210 to the ground electrode 1220. In an embodiment, the power electrode 1210 surrounds the center shaft of the body 1100 and has a helical shape having a plurality of turns arranged along a lengthwise of the body 1100. A distance between the turns close to each other of the power electrode 1210 may be the same.

The ground electrode 1220 is grounded. In an embodiment, the ground electrode 1220 surrounds the center shaft of the body 1100 and has a helical shape having a plurality of turns arranged along a lengthwise of the body 1100. A distance between the turns close to each other of the ground electrode 1220 may be the same.

When viewed from a lateral side, each of the turns of the power electrode 1210 and the turns of the ground electrode 1220 are departed from each other. The turn of the power electrode 1210 is provided closer to a turn which is closer to a spray hole where the fluid of the body 1100 is sprayed among the turns of the ground electrode 1220. Therefore, a direction of the electric field looks toward the spray hole from each turn of the power electrode 1210. And accelerates a positive ion 31 of plasma 30 toward the spray hole.

The distance between the turns close to each other of the power electrode 1210 and the distance between the turns close to each other of the ground electrode 1220 may be the same. The power electrode 1210 may be provided to the inner lateral surface of the dielectric unit 1110, and the ground electrode 1220 may be provided to an outer lateral surface of the dielectric unit 1110. As the power electrode 1210 is provided in the inner lateral surface of the dielectric unit 1110, it may generate a stronger electric field than provided in the outer lateral surface of the dielectric unit 1110. Therefore, the power electrode 1210 is provided in the inner lateral surface of the dielectric unit 1110 may accelerate the positive ion 31 of the plasma 30 more effectively. As the ground electrode 1220 provided in the outer lateral surface of the dielectric unit 1110, and the both of the power electrode 1210 and the ground electrode 1220 are provided in the inner lateral surface, an arcing may be prevented which may generated in the inner lateral surface of the dielectric unit 1110.

A power electrode groove 1111 where the power electrode 1210 is inserted is formed in the inner lateral surface of the dielectric unit 1110. A ground electrode groove 1112 where the ground electrode 1220 is inserted is formed in the outer lateral surface of the dielectric unit 1110. It is not easy to fixedly connect the power electrode 1210 and the ground electrode 1220 to the inner lateral surface or the outer lateral surface of the dielectric unit 1110. The power electrode 1210 and ground electrode 1220 may be easily fixedly connected to the dielectric unit 1110 by forming the power electrode groove 1111 and the ground electrode groove 1112 in the dielectric unit 1110 and inserting the power electrode 1210 and the ground electrode 1220, respectively. When the power electrode 1210 is inserted in the dielectric unit 1110, a surface of the power electrode 1210 which faces a center of the body 1100 is exposed. Therefore, it may generate a stronger electric field than totally inserting the power electrode 1210 in the dielectric unit 1110.

Figure 6:
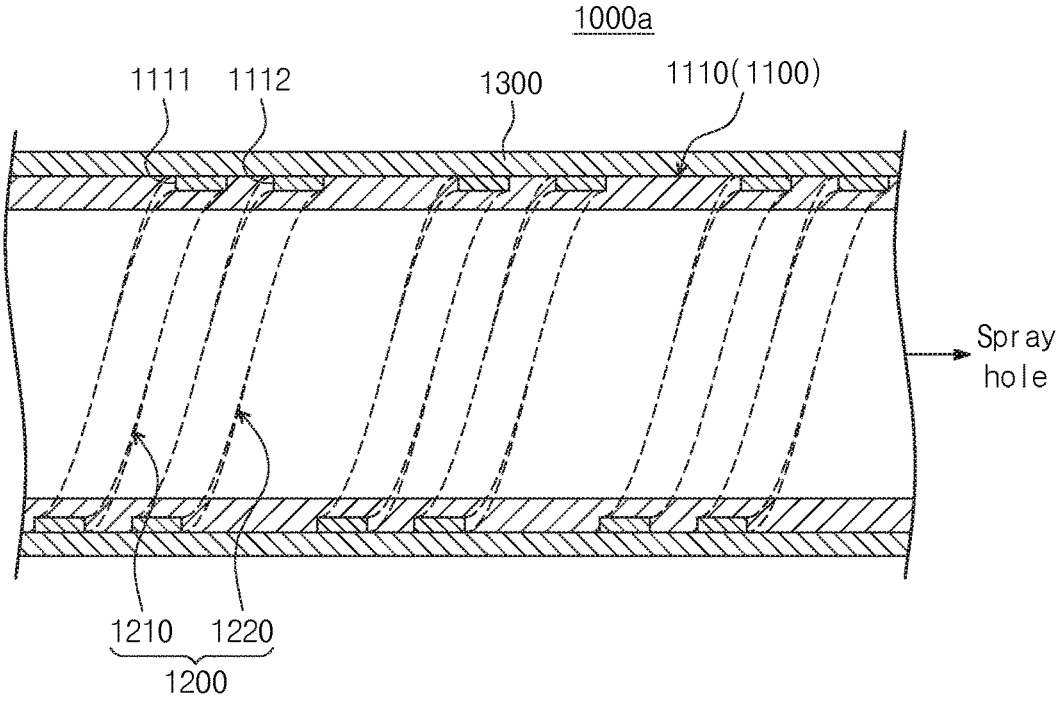
FIG. 6 is a lateral cross-sectional view of a part of a nozzle unit of FIG. 2 in accordance with an embodiment.

FIG. 6 is a lateral cross-sectional view of a part of a nozzle unit 1000*a* of FIG. 2 in accordance with an embodiment. Referring to FIG. 6, the power electrode 1210 and the ground electrode 1220 may be provided in the outer lateral surface of the dielectric unit 1110. The power electrode groove 1111 and the ground electrode groove 1112 may be formed in the outer lateral surface of the dielectric unit 1110. When the power electrode 1210 and the ground electrode 1220 are provided in the inner lateral surface of the dielectric unit 1110, or when the power electrode 1210 is provided in the inner lateral surface of the dielectric unit 1110 and the ground electrode 1220 is provided in the outer lateral surface of the dielectric unit 1110, the electric field may become weaker and the arcing may be prevented. When the both of the power electrode 1210 and the ground electrode 1220 are provided in the outer lateral surface of the dielectric unit 1110, an arcing may happen in the outer lateral surface of the dielectric unit 1110. Therefore, the nozzle unit 1000 may further comprise an insulator 1300. The insulator 1300 surrounds the outer lateral surface of the dielectric unit 1110 so that the power electrode 1210 and the ground electrode 1220 do not expose to outside. To prevent the arcing from the outer lateral surface of the dielectric unit 1110, a surface of the power electrode 1210 and the ground electrode 1220 which is exposed to outside is insulated with the insulator 1300. It is easier to form the power electrode groove 1111 and to install the power electrode 1210 than installing the power electrode 1210 by forming the power electrode groove 1111 in the inner lateral surface therein. A composition, structure, shape, and function of the nozzle unit 1000*a* are similar to the nozzle unit 1000 of FIG. 5.

Figure 7:
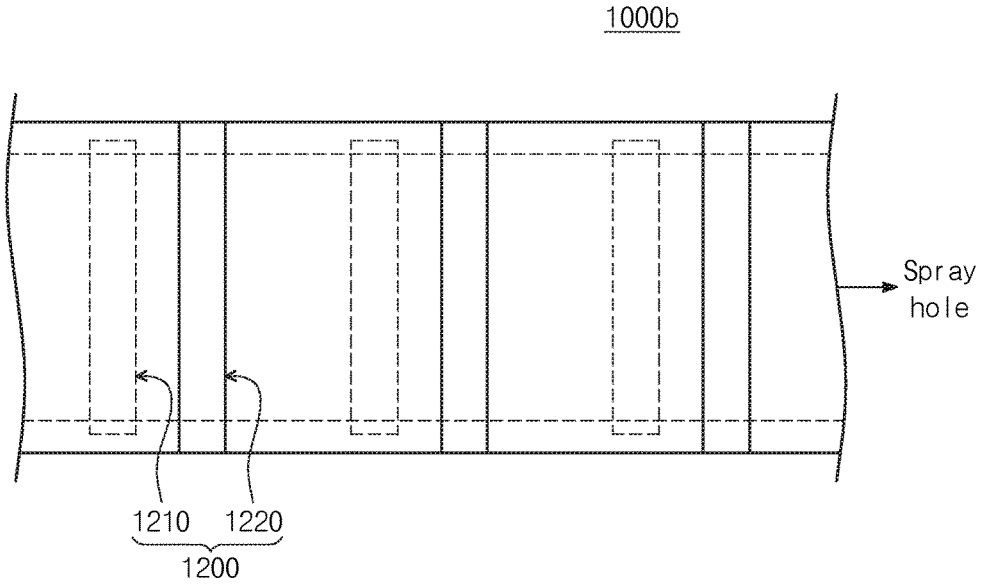
FIG. 7 is a lateral view sectional view of a part of a nozzle unit of FIG. 2 in accordance with another embodiment.

FIG. 7 is a lateral view sectional view of a part of a nozzle unit 1000*b* of FIG. 2 in accordance with another embodiment. Referring to FIG. 7, the power electrode 1210 may surround a center shaft of the body 1100 and may be a plurality of rings arranged along a lengthwise of the body 1100. The rings of the power electrode 1210 are electrically connected. A distance between the rings close to each other of the power electrode 1210 may be the same.

The ground electrode 1220 may surround a center shaft of the body 1100 and may be a plurality of rings arranged along a lengthwise of the body 1100. The rings of the ground electrode 1220 are electrically connected. A distance between the rings close to each other of the ground electrode 1220 may be the same.

Each ring of the power electrode 1210 and each ring of the ground electrode 1220 are arranged alternately, when viewed from a lateral side. The ring of the power electrode 1210 is provided closer to a ring which is closer to a spray hole where the fluid of the body is sprayed among the rings of the ground electrode 1220. The distance between the rings close to each other of the power electrode 1210 and the distance between the rings close to each other of the ground electrode 1220 may be the same. A composition, structure, shape, and function of the nozzle unit 1000*b* are similar to the nozzle unit 1000 of FIG. 5.

Except in case of FIGS. 5 to 7, the nozzle unit may be provided with various compositions to accelerate the positive ion 31 of plasma 30 toward the spray hole of the body 1100.

As described above, with the power electrode 1210 and the ground electrode 1220, the fluid adjacent to the inner lateral surface of the dielectric unit 1110 is applied to the plasma 30. And, an electric field is formed along the rings or turns closer to the spray hole of the ground electrode 1220 in respective to the turns or rings of the power electrode 1210. Therefore, the positive ion 31 of the plasma 30 which is generated from the fluid close to the inner lateral surface of the dielectric unit 1110 by the electric field is accelerated. As the above positive ion 31 of the plasma 30 is accelerated, a decrease in a flow velocity in an area adjacent to an inner lateral surface of the body 1100 may be prevented. Therefore, an additional pressure energy is not needed to prevent decrease in a flow velocity, thereby energy efficiency may be increased. Also, a velocity needed for a coating material to collide with the coating objects 20 is provided, thereby minimize poor coating and easily form thicker coating layer.

Again referring to FIG. 2, the fluid supply unit 2000 supplies the fluid to the nozzle unit 1000. In an embodiment, the fluid supply unit 2000 includes a coating material supply member 2100 and a gas supply member 2200. The fluid may include a pressure gas applying a power to spray the coating material and a coating material to be coated.

The coating material supply member 2100 supplies a coating material through the passageway in the body 1100. The coating material may be a powder form. For example, the coating material may include $Y_2O_3$, $Al_2O_3$, or $SiO_2$.

The gas supply member 2200 supplies a pressure gas through the passageway in the body 1100. The pressure gas may be inert gas. For example, the pressure gas may be He, Ar, $N_2$, or $H_2$.

What is claimed is:

1. A coating apparatus comprising:

a support unit configured to support a coating object; and a spray assembly configured to spray a fluid which includes a coating material to be coated by the coating object supported on the support unit, wherein the spray assembly comprises, a nozzle unit where the fluid is sprayed, and a fluid supply unit configured to supply the fluid to the nozzle unit, wherein the nozzle unit comprises, a body including a passageway for the fluid therein and a dielectric unit provided with a dielectric material, and a plasma source for generating plasma from the fluid which flows to an area adjacent to an inner lateral surface of the dielectric unit, wherein the plasma source comprises, a power electrode configured to apply a power, and a ground electrode configured to be grounded, wherein the power electrode and the ground electrode are mounted on the dielectric unit, wherein the power electrode surrounds a center shaft of the body and is in a helical shape having a plurality of turns arranged along a lengthwise direction of the body, wherein the ground electrode surrounds the center shaft of the body and is in a helical shape having a plurality of turns arranged along the lengthwise direction of the body, and wherein each of the turns of the power electrode and the turns of the ground electrode are departed from each other, when viewed from a lateral side.

2. The coating apparatus of claim 1, wherein the power electrode and the ground electrode are placed apart from each other in the dielectric unit.

3. The coating apparatus of claim 1, wherein the turn of the power electrode is provided closer to a turn which is closer to a spray hole where the fluid of the body is sprayed among the turns of the ground electrode.

4. The coating apparatus of claim 3, wherein each distance between the turns close to each other of the power electrode is the same, and each distance between the turns close to each other of the ground electrode is the same.

5. The coating apparatus of claim 4, wherein the distance between the turns close to each other of the power electrode and the distance between the turns close to each other of the ground electrode are the same.

6. The coating apparatus of claim 1, wherein the power electrode is placed such that an outer lateral surface of the power electrode is further apart from the inner lateral surface of the dielectric unit with respect to a center shaft of the body.

7. The coating apparatus of claim 1, wherein the power electrode is provided to the inner lateral surface of the dielectric unit, and the ground electrode is provided to an outer lateral surface of the dielectric unit.

8. The coating apparatus of claim 6, wherein the dielectric unit forms a power electrode groove inserted with the power electrode in the inner lateral surface and forms a ground electrode groove inserted with the ground electrode in the outer lateral surface.

9. The coating apparatus of claim 1, wherein the power electrode and the ground electrode are provided in an outer lateral surface of the dielectric unit.

10. The coating apparatus of claim 9, wherein the dielectric unit includes a power electrode groove inserted with the power electrode and a ground electrode groove inserted with the ground electrode in the outer lateral surface.

11. The coating apparatus of claim 10, wherein the nozzle unit further comprises an insulator surrounding the outer lateral surface of the dielectric unit so that the power electrode and the ground electrode are not expose to outside.

12. The coating apparatus of claim 1, wherein the fluid supply unit comprises:

a coating material supply member configured to supply the coating material; and a gas supply member configured to supply a pressure gas for applying a power to spray the coating material.

13. The coating apparatus of claim 12, wherein the coating material is provided with a powder form.

* * * * *